United States Patent [19]

Rankel et al.

[11] Patent Number: 4,530,757

[45] Date of Patent: Jul. 23, 1985

[54] PROCESS FOR UPGRADING HEAVY CRUDE OILS

[75] Inventors: Lillian A. Rankel, Princeton; Paul Shu, Princeton Junction, both of N.J.

[73] Assignee: Mobil Oil Corporation, New York, N.Y.

[21] Appl. No.: 594,582

[22] Filed: Mar. 29, 1984

[51] Int. Cl.[3] ..... C10G 25/00; C10G 25/05

[52] U.S. Cl. ..... 208/251 R; 208/5; 208/49; 208/50; 208/106

[58] Field of Search ..... 208/5, 49, 50, 106, 208/251 R

[56] References Cited

U.S. PATENT DOCUMENTS

| | | | |
|---|---|---|---|
| 2,044,014 | 6/1936 | Penniman | 208/5 |
| 2,347,805 | 5/1944 | Bell | 208/50 |
| 2,390,556 | 12/1945 | Ruthriff | 208/49 |
| 2,905,615 | 9/1959 | Arey, Jr. | 208/50 |
| 2,998,354 | 8/1961 | Brown et al. | 208/50 |
| 3,112,181 | 11/1963 | Petersen et al. | 208/50 |
| 3,671,421 | 6/1972 | Peck et al. | 208/49 |
| 3,702,816 | 11/1972 | Buchmann | 208/106 |
| 3,960,704 | 6/1976 | Kegler et al. | 208/50 |
| 4,358,361 | 11/1982 | Peters | 208/89 |
| 4,379,747 | 4/1983 | Yan | 208/251 H |

FOREIGN PATENT DOCUMENTS

| | | | |
|---|---|---|---|
| 537109 | 12/1976 | U.S.S.R. | 208/5 |

*Primary Examiner*—D. E. Gantz
*Assistant Examiner*—Helane Myers
*Attorney, Agent, or Firm*—Alexander J. McKillop; Michael G. Gilman; Howard M. Flournoy

[57] ABSTRACT

A combination process of oxidation/mild coking and in-situ deasphalting provides a process wherein upgraded crude with high levels of demetalation and low solids rejection is produced.

6 Claims, 1 Drawing Figure

OXIDATION / MILD COKING / IN-SITU DEASPHALTER SCHEMATIC
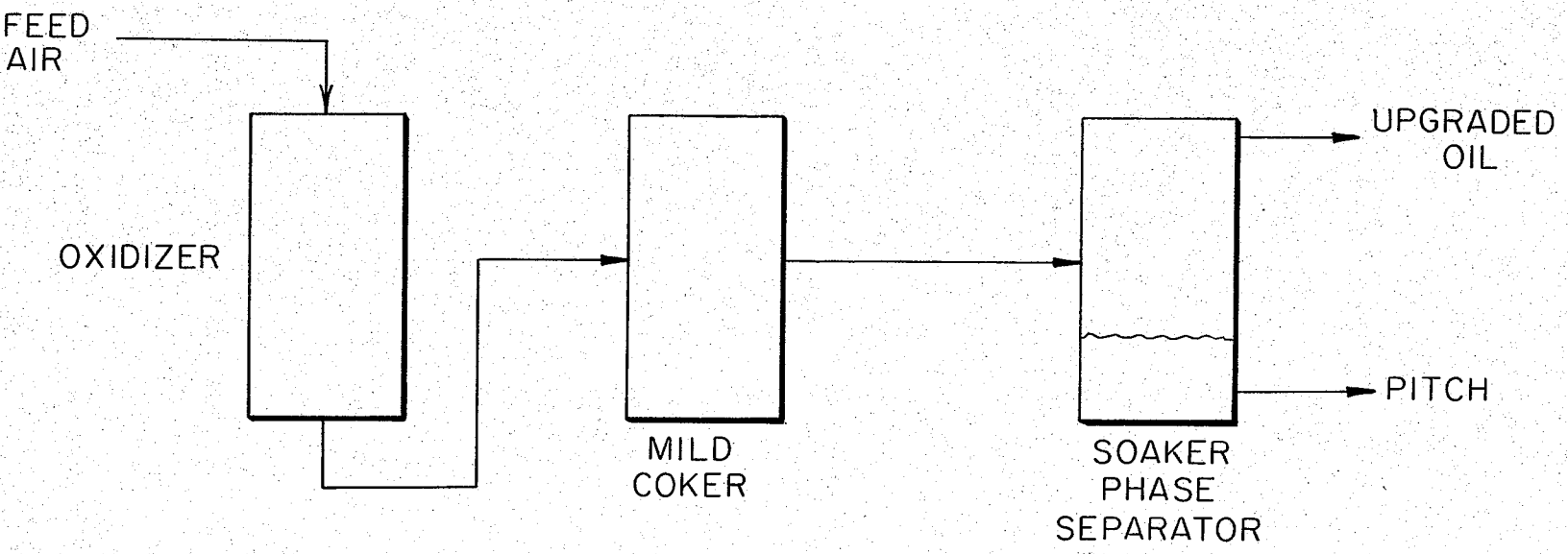

PROCESS FOR UPGRADING HEAVY CRUDE OILS

BACKGROUND OF THE INVENTION

This application is directed to the upgrading of heavy crude oils. More particularly, this application is directed to a process of rendering such crudes suitable as feed for conventional refinery processes comprising oxidation of the heavy crude followed by mild coking and in situ deasphalting which produces high levels of demetalation with low solids rejection.

Oxidation/deasphalting and mild coking/in-situ deasphalting are processes individually known to be suitable for demetalizing heavy crude oils.

U.S. Pat. No. 4,379,747 discloses demetalation/deasphalting in coal liquefaction processes.

U.S. Pat. No. 4,358,361 and U.S. Pat. No. 4,089,771 disclose processes wherein residual oil fractions are coked following conventional demetalation processes.

However, in the instant process, the combination of oxidation/mild coking/in-situ deasphalting is novel offering several advantages. For example, it is a continuous process that gives higher levels of demetalation than mild coking/in-situ deasphalting while producing less rejected material than oxidation/deasphalting. This is of particular significance since heavy crudes will be a more abundant source of fuel in the future because light crude supplies are decreasing. Therefore, demetalation and upgrading of heavy crudes prior to downstream processing will become more and more a necessity if such materials are to be used in conventional refinery systems.

SUMMARY OF THE INVENTION

It has now been discovered that the removal of metals from heavy crude oils can be significantly improved by the methods disclosed in the present invention. This invention comprises a combination process of oxidation/mild coking/in-situ deasphalting resulting in upgraded crude with high levels of demetalation and low solids rejection. Therefore, this invention is particularly directed to an improved method for upgrading heavy crude oil or similar heavy hydrocarbon fluids comprising a continuous combination process wherein said crude in a suitable reaction vessel and under suitable conditions of time, temperature and pressure is oxidized in a first stage and immediately thereafter passed to a second stage for mild coking and thereafter to a settler wherein light hydrocarbons present in the crude, plus any cracking generated hydrocarbons provide in-situ deasphalting thereby producing upgraded crude having high levels of demetalation and low levels of rejected solids. The crude so upgraded is then suitable for processing in, for example, conventional FCC, hydrotreater and coker units.

BRIEF DESCRIPTION OF THE DRAWING

The FIGURE summarizes an embodiment of the process disclosed herein.

DESCRIPTION OF SPECIFIC EMBODIMENTS

The invention may be conveniently practiced in any suitable oxidizer reactor capable of operating within the following parameters: temperatures of from about 200° to about 270° C.; about 100 to about 300 psig air preferably 150–300 psig, 1000 to 4000 SCF/BBL air flow, LHSV of about 1 to about 5 hours. The oxidizer is usually packed with sand (for good mixing) or an oxidation catalyst such as $V_2O_5$. Other suitable catalysts include, but are not limited to the oxides or sulfides of cobalt, nickel, iron and molybdenum, or alumina or mixtures thereof.

After oxidation the heavy crude oil acquires from about 0.5 to about 3 weight percent oxygen and then is ready for the second stage of the combination process, the mild coking step.

The coking unit usually operates at temperatures of from about 750° to about 900° F. and preferably about 850° to about 870° F., pressures of from about 250 to 500 psig, preferably about 400 psig and LHSV of from about 3 to about 5 hours$^{-1}$, preferably about 4 hours$^{-1}$. After the oxidized crude has undergone the mild coking, it passes into the settler where the resident time ranges from about 0.1 to about 3 hours. The light hydrocarbons present in the crude plus any cracking generated hydrocarbons give the in-situ deasphalting in the settler. Approximately 9% of the settler lower phase is removed as pitch which contains most of the nickel and vanadium metal impurities. The upper phase in the settler is demetalated by about 88.8% when the oxidized heavy crude is processed in accordance with the invention while untreated heavy crude is demetalated by about 76.8%. A schematic for the overall process is shown in the FIGURE. In the FIGURE an oxidized, mild coker and solvent phase/separator or settler is depicted. The feed to be upgraded and air are fed to the oxidizer, after suitable residence time therein the oxidized oil effluent passes to the coker for mild coking and then directly to the settler wherein the upgraded oil and pitch are separated. Pitch settles into the bottom of the separatory vessel and the upgraded oil is removed from the top thereof.

Heavy crude oils which generally have metal contamination of 70 ppm or more are particularly suitable to a process as embodied herein.

The invention is further illustrated by the example which follows below.

EXAMPLE

Oxidation/Mild Coking/In Situ Deasphalting

| Feed: | Arab Heavy Crude | |
|---|---|---|
| | % C | 83.3 |
| | H | 11.8 |
| | N | 0.16 |
| | O | <0.1 |
| | S | 2.89 |
| | ppm Ni | 18.6 |
| | V | 57.1 |

Oxidation Conditions

240° C., trickle-bed reactor, $V_2O_5/Al_2O_3$ catalyst, LHSV=2 hours$^{-1}$, flowing air, 200 psig, gas makes <1%, material balance >98%

1.77% oxygen in oxidized oil

This oil was then used in the mild coking/in-situ deasphalting stages of the continuous process.

Upgrading of Oxidized Arab Heavy Crude By Mild Coking/In-situ Deasphalting

| Feed | Arab Heavy | Oxidized Arab Heavy |
|---|---|---|
| Reaction Conditions | | |

-continued

| Upgrading of Oxidized Arab Heavy Crude By Mild Coking/In-situ Deasphalting | | |
|---|---|---|
| Temp., °F. | 870 | 870 |
| Pressure, psig | 400 | 400 |
| Feed rate, LHSV | 4 | 4 |
| Settler resident time, min. | 30 | 30 |
| | Product Yield | |
| Upper phase, wt. % | 87.3 | 89.8 |
| Lower phase, wt. % | 8.7 | 9.0 |
| Gas, wt. % | 4 | 1.2 |

| | Ni, ppm | V, ppm | Toluene Insolubles, % | Demetalation |
|---|---|---|---|---|
| | Product Properties | | | |
| Feed (AH) | 18.6 | 57.1 | 0.1 | — |
| Feed (AH oxidized) | 18.6 | 57.1 | — | — |
| AH upper phase product | 4.6 | 13 | 0.1 | 76.8 |
| AH oxidized upper phase product | 2.5 | 6 | 0.1 | 88.8 |

As can be seen from the example, considerable demetalation takes place by practice of the combination process embodied herein. The improvement in the oxidized product over the unoxidized product clearly demonstrates a highly significant advantage of the instant and novel process.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A method for upgrading heavy crude oil which comprises oxidizing said crude oil in a first stage to produce an oxidized oil containing from about 0.5 to 3.0 wt. % oxygen, introducing said oxidized oil to a second stage coking zone wherein the oil is subjected to mild coking at a temperature of about 750° to 900° F. under a pressure of about 250 to 500 psig and a liquid hourly space velocity (LHSV) of about 3 to 5 hours$^{-1}$; introducing the coked oil to a third stage settling zone for a period of time of 0.1 to about 3 hours, and thereafter recovering an upper phase product of reduced metal content.

2. The process of claim 1 wherein the oxidation conditions vary from about 200° to 270° C., 150 to about 300 psig air and from about 1000 to about 4000 SCF/BBL air flow and a LHSV of from about 1 to about 5 hours.

3. The process of claim 1 wherein the oxidation reaction vessel is packed with sand.

4. The process of claim 2 wherein a catalyst is utilized in the oxizidation reaction vessel.

5. The process of claim 4 wherein the catalyst is $V_2O_5$.

6. The process of claim 4 wherein the catalyst is $V_2O_5/Al_2O_3$.

* * * * *